US007950342B2

(12) United States Patent
Russikoff

(10) Patent No.: US 7,950,342 B2
(45) Date of Patent: May 31, 2011

(54) AUTOMATED BIMINI TOP DEVICE

(76) Inventor: Ronald K. Russikoff, Philadelphia, PA (US)

( * ) Notice: Subject to any disclaimer, the term of this patent is extended or adjusted under 35 U.S.C. 154(b) by 45 days.

(21) Appl. No.: 12/587,149

(22) Filed: Oct. 2, 2009

(65) Prior Publication Data

US 2010/0083891 A1 Apr. 8, 2010

Related U.S. Application Data

(60) Provisional application No. 61/195,103, filed on Oct. 3, 2008.

(51) Int. Cl.
*B63B 17/02* (2006.01)

(52) U.S. Cl. ..... 114/361

(58) Field of Classification Search ..... 114/361; 135/88.01

See application file for complete search history.

(56) References Cited

U.S. PATENT DOCUMENTS

| | | | | |
|---|---|---|---|---|
| 2,513,764 | A * | 7/1950 | Vonder Ahe | 114/361 |
| 5,303,667 | A * | 4/1994 | Zirkelbach et al. | 114/361 |
| 2009/0229508 | A1 * | 9/2009 | James | 114/361 |

* cited by examiner

*Primary Examiner* — Ed Swinehart
(74) *Attorney, Agent, or Firm* — Armand M. Vozzo, Jr.

(57) ABSTRACT

An automated bimini top device comprises a foldable frame assembly adapted to carry a flexible canvas material thereon and powered to move the canvas selectively between a retracted position and an extended position. The frame assembly includes a rear bow member supported in a fixed raised position, a front bow member adapted to slide along a length of the rear bow and pivot relative thereto, and a middle bow member pivotally connected along the length of the front bow and adapted to move in an opposite rotational direction thereto. Actuator means assembled to the rear bow member are operatively connected to move the front bow member in reversible directions outward and away from the rear bow into the extended position and inward and toward the rear bow into the retracted position. The middle bow member is coupled to a guide strap support connected between the rear and front bow members and further attached beneath the canvas material to maintain contact with the canvas during retraction and provide central support thereof in the extended position.

6 Claims, 6 Drawing Sheets

AUTOMATED BIMINI TOP DEVICE

CROSS-REFERENCE TO RELATED APPLICATION

This application is a continuation-in-part of provisional patent application Ser. No. 61/195,103 filed Oct. 3, 2008 for Automated Bimini Top Device.

BACKGROUND OF THE INVENTION

The present invention relates to convertible top covers for boats, commonly called bimini tops, and more particularly to an improved automated bimini top device having a movable framework specially adapted and powered to move between an extended and retracted position in a free-standing unit that is readily mounted upon a boat deck or radar arch without any additional supporting framework or binding straps.

In recreational boating, the so-called "bimini top" is a convertible cover erected upon the deck of the boat and made to be deployed at an elevation comfortably above the heads of the passengers. Drawing its name from the Bimini islands in the Bahamas where it was first employed by boaters to provide desired shade from the strong rays of the tropical sun, the standard type of bimini top and those convertible boat covers of the same nature generally comprise a flexible canvas material secured to a foldable support frame that is erected across the deck and pivotally attached thereto. These standard types of foldable bimini tops can be raised when needed or lowered into a substantially flat position upon the deck when not in use or when an overhead obstruction may otherwise require its lowering. Deployment of these foldable bimini tops is often done manually but has been designed to be power driven, such as those described in U.S. Pat. No. 6,209,477 to Briedenweg and U.S. Pat. No. 6,983,716 to Ankney et al.

While prior art systems for automatic retractable bimini tops have been satisfactory in their operation, their movable support frames with pivotal rods and struts have been somewhat complicated in construction and have not afforded easy mounted attachment to the boat deck or other rigid structure such as radar arches typically found on recreational boats of today. In view of the recognized harm cause by extended exposure to the sun and in appreciation of the benefits of providing sun protection for those onboard recreational boats, it warrants having a convertible bimini top on a recreational boat whenever possible, and providing an associated structure that is automated and easy to attach to existing boats is of significant value and importance for the protection of passengers and crew on board boats against excessive sun exposure and the evident risks of skin cancer caused thereby.

SUMMARY OF THE INVENTION

Accordingly, it is a general purpose and object of the present invention to provide an improved retractable bimini top for recreational boats that is fully automated and capable of easy mounted attachment to the deck of the boat or other rigid supporting structure thereon.

A more particular object of the present invention is to provide an improved automated bimini top device capable of deployment in a free-standing unit that is readily mounted upon a boat deck or radar arch without any additional supporting framework or binding straps.

Another object of the present invention is to provide an automated bimini top device for recreational boats that is capable of providing effective sunshade protection to persons on board the boat without presenting obstructions to their movement or performance of tasks on or around the deck.

Still another object of the present invention is to provide an improved automated bimini top device that is particularly suitable for retrofitting existing recreational boats with needed means for shade protection of those on board.

A further object of the present invention is to provide an automated bimini top device that is capable of hands free operation and supplying shade protection quickly and reliably whenever required.

A still further object of the present invention is to provide an automated bimini top device that is relatively inexpensive to manufacture, easy to assemble and ready to install upon existing boat structure.

Briefly, these and other objects of the present invention are accomplished by an automated bimini top device comprising a foldable frame assembly adapted to carry a flexible canvas material thereon and powered to move the canvas selectively between a retracted position and an extended position. The frame assembly includes a rear bow member supported in a fixed raised position, a front bow member adapted to slide along a length of the rear bow and pivot relative thereto, and a middle bow member pivotally connected along the length of the front bow and adapted to move in an opposite rotational direction thereto. Actuator means assembled to the rear bow member are operatively connected to move the front bow member in reversible directions outward and away from the rear bow into the extended position and inward and toward the rear bow into the retracted position. The middle bow member is coupled to a guide strap connected between the rear and front bow members and further attached beneath the canvas material to maintain contact with the canvas during retraction and provide central support thereof in the extended position.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DESCRIPTION OF THE INVENTION

Figure 1:
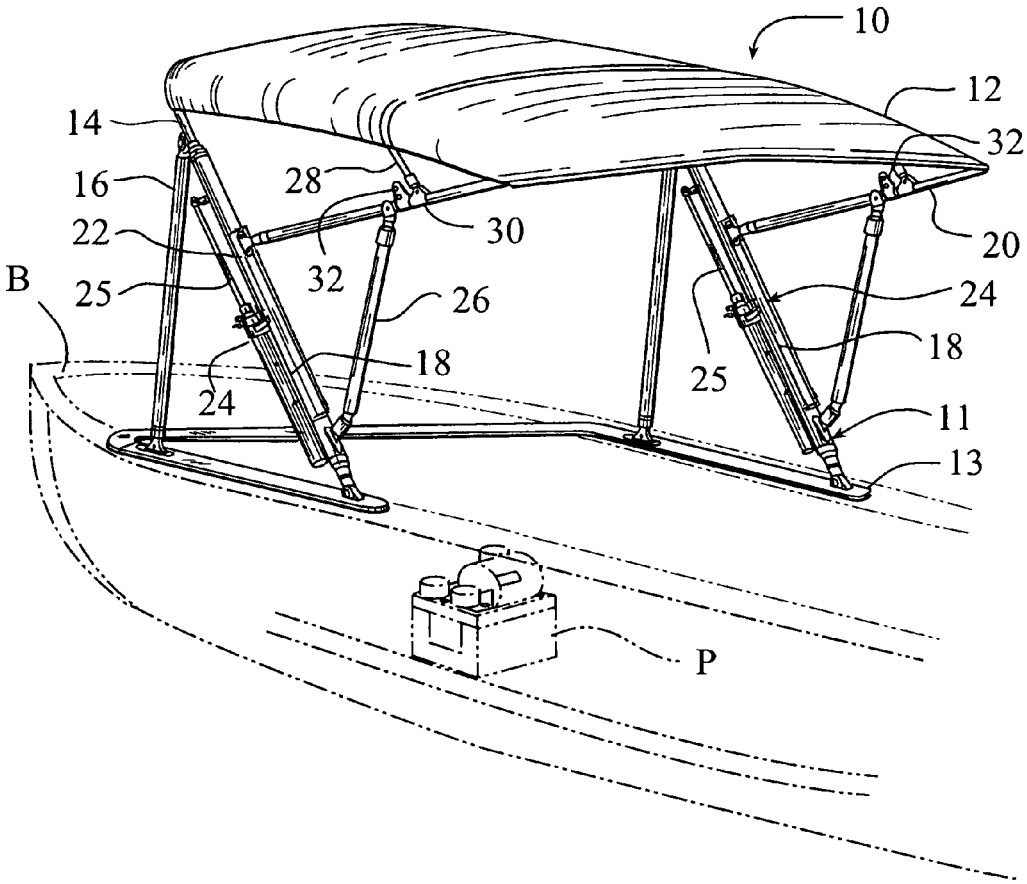
FIG. 1 is a perspective side view of the automated bimini top device of the present invention shown with its canvas top in its fully deployed state.
Figure 2:
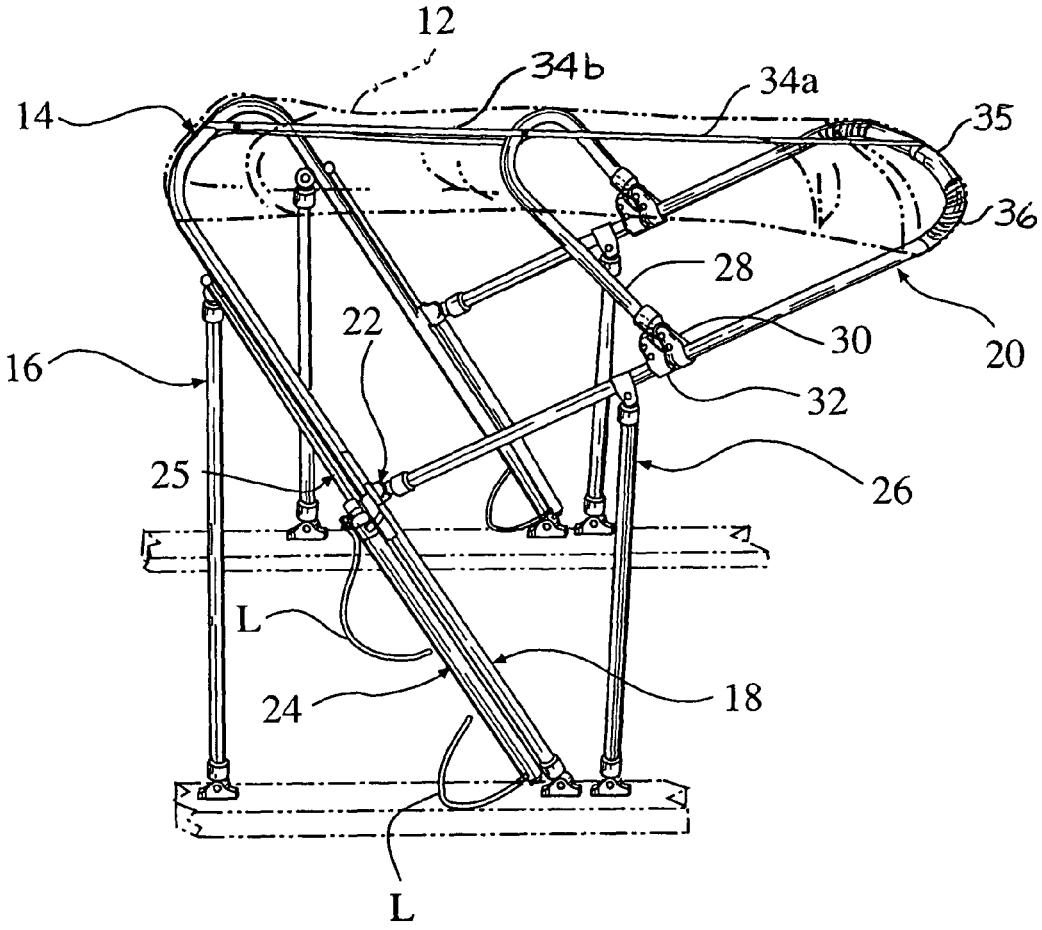
FIG. 2 is a further perspective side view of the automated bimini top device of FIG. 1 with the canvas top appearing in phantom to show the underlying frame assembly in its extended state.

The following serves to describe a preferred embodiment of the present invention and the best presently contemplated mode of its production and practice. This description is further made for the purpose of illustrating the general principles of the invention but should not be taken in a limiting sense, the scope of the invention being best determined by reference to any associated claims.

Referring to the drawings, the following is a list of structural elements of the present automated bimini top device, generally designated 10, and those associated elements shown employed in connection with the present invention:

10 automated bimini top device;
11 fold-away frame assembly;
12 canvas material;
13 mounting plate;
14 rear bow member;
16 rear support struts;
18 guide tracks;
20 front bow member;
22 hinge slides;
24 hydraulic actuators;
25 actuator drive arms;
26 front support struts;
28 middle bow member;
30 jaw slides;
32 jaw slide stops;
34 guide strap support;
34*a* guide strap line;
34*b* guide strap loop;
35 take-up roller;
36 torsion spring;
B boat;
P hydraulic pump; and
L hydraulic lines.

Figure 6:
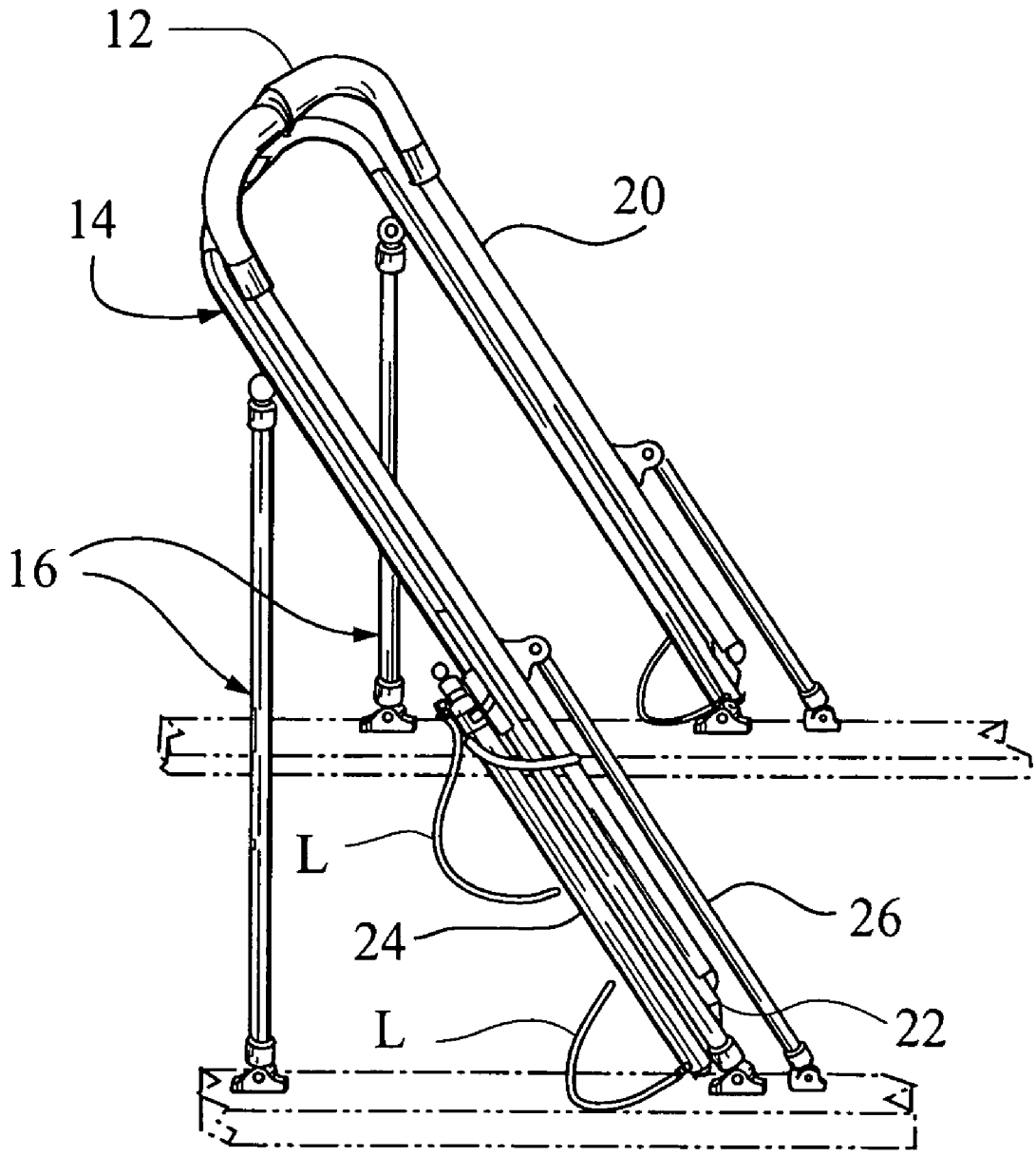
FIG. 6 is a side perspective view of the underlying frame assembly of the present automated bimini top device in its fully retracted state.

The present automated bimini top device 10 comprises a fold-away frame assembly 11 that is adapted to support a flexible canvas material 12 thereon and powered to move the canvas material automatically between a retracted position, as seen in FIG. 6, and an extended, fully deployed position, as seen in FIG. 1. Use of hydraulic power is preferred to move the frame assembly 11 in its intended fashion and would be provided by conventional hydraulic pump P (shown in phantom outline) mounted and installed upon the boat structure. Alternatively, pneumatic or electrical power may be used. A mounting plate 13 shown in FIG. 1 formed in a U-shaped configuration may be used to couple the present device 10 and its fold-away frame assembly 11 to the boat structure B providing an integral attachment surface for mounting the device 10 across the deck of the boat. Mounting of the present bimini top device 10 may alternatively be made by separate plates secured on either side of the deck or directly to the boat structure on each side.

Referring now to FIGS. 2 through 5, the working framework of the fold-away frame assembly 11 is made from a strong, durable and corrosion-resistant material, such as stainless steel or aluminum alloy, and includes a rear bow 14 raised and supported upon the mounting plate 13 with a pair of rear support struts 16 fixed in a substantially erect attitude upon the mounting plate and connected near the top of the side legs of the rear bow on either side to keep the frame assembly upright and free-standing in the sense it does not need to be affixed to any overhead structure. The rear bow 14, as are those other working bow members of the frame assembly 11 described below, is a tubular member formed in a substantially U-shaped configuration having a crossbar extending between opposite side legs. Along the lower portion of each side leg of the rear bow 14, a guide track 18 channel-like in form is disposed and adapted to engage a deck hinge slide 22 pivotally connected at the foot of each side leg of a front bow 20 on either side thereof. In this connection, the hinge slide 22 may be moved through the guide track 18 in either direction and thereby move the front bow 20 with associated rotation in a direction that will either extend or retract the frame assembly 11. A front support strut 26 pivotally mounted on either side of the frame assembly 11 is extended upward and pivotally connected at the top thereof to an intermediate position along each side leg of the front bow 20 to allow for proper folding movement of the front bow.

A conventional hydraulic actuator 24 cylindrical in form is connected to the pump P via tubular lines L and is mounted along each side leg of the rear bow 14 in connection with the guide track 18 to generate movement of the hinge slides 22 along the guide track that drives the deployment of the frame assembly 11, particularly the front bow 20. The actuator drive arm 25, typically a shaft-like member made to move outward and inward of the hydraulic actuator 24 in controlled strokes under hydraulic pressure, is coupled to the hinge slide 22 disposed within the guide track 18 on each side leg of the front bow 20. When the hydraulic actuators 24 are activated, the drive arms 25 will move accordingly and push (for extending) or pull (for retracting) the bottom of the front bow 20 along the guide track 18 via hinge slides 22. While the front bow 20 is being pushed from its bottom by the actuators 24, the front support struts 26 rotate to a substantially erect position to support the front bow when fully extended.

Figure 3:
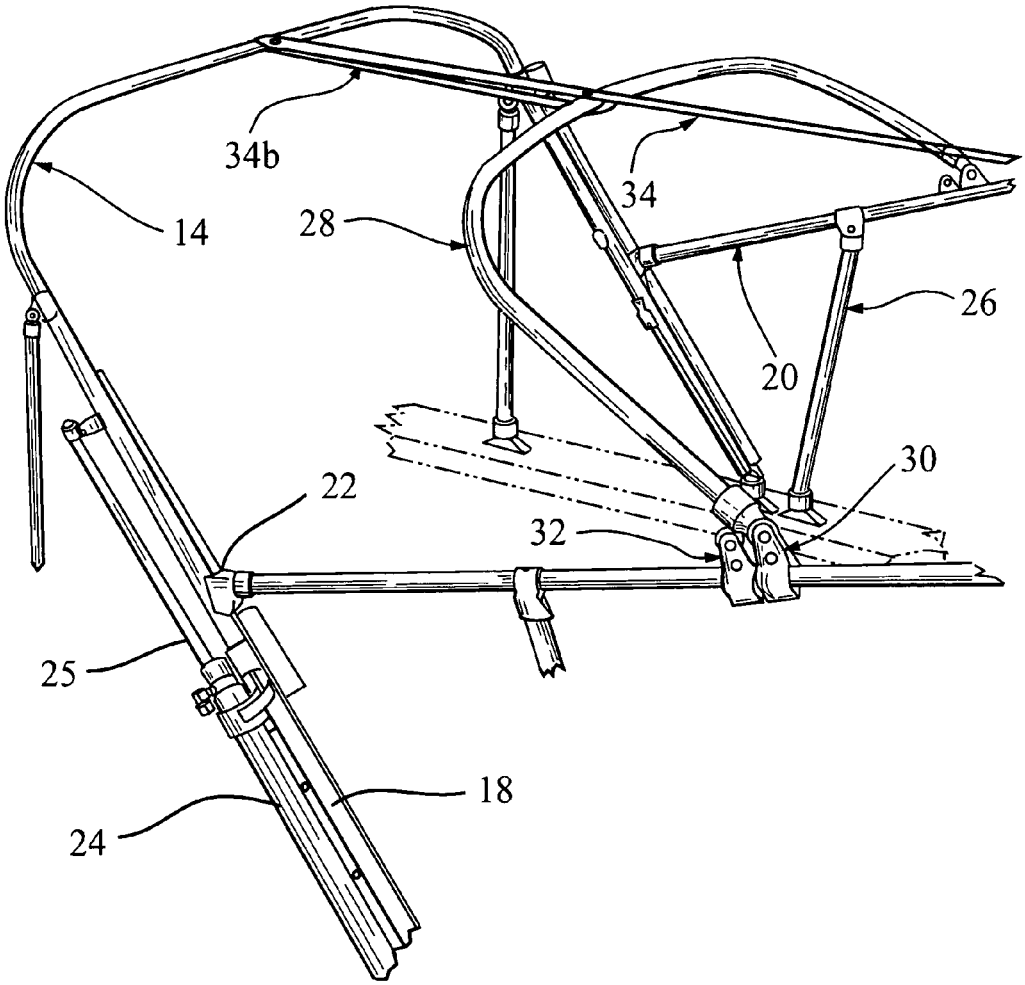
FIG. 3 is an upper side perspective view of the top portion of the fully extended frame assembly of the present automated bimini top device shown in FIG. 2.
Figure 4:
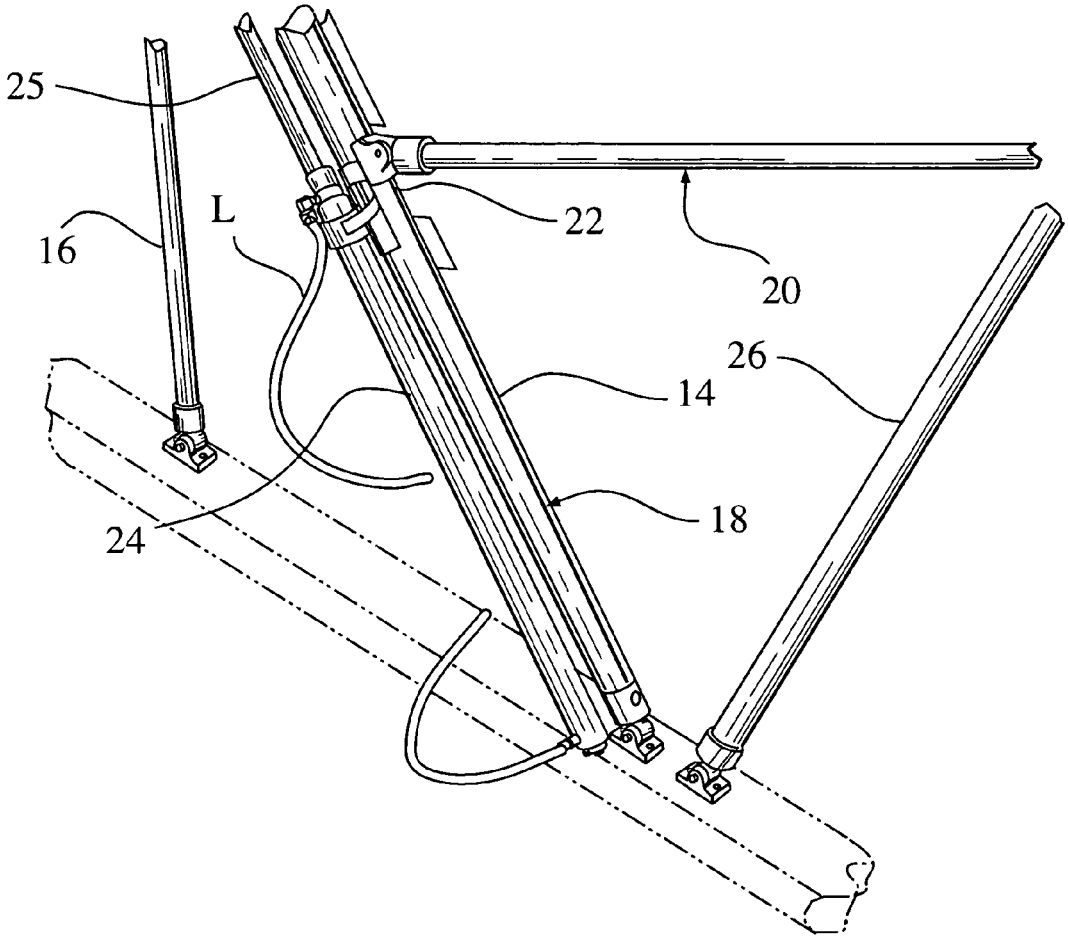
FIG. 4 is a lower side perspective view of the bottom portion of the fully extended frame assembly of the present automated bimini top device shown in FIG. 2.
Figure 5:
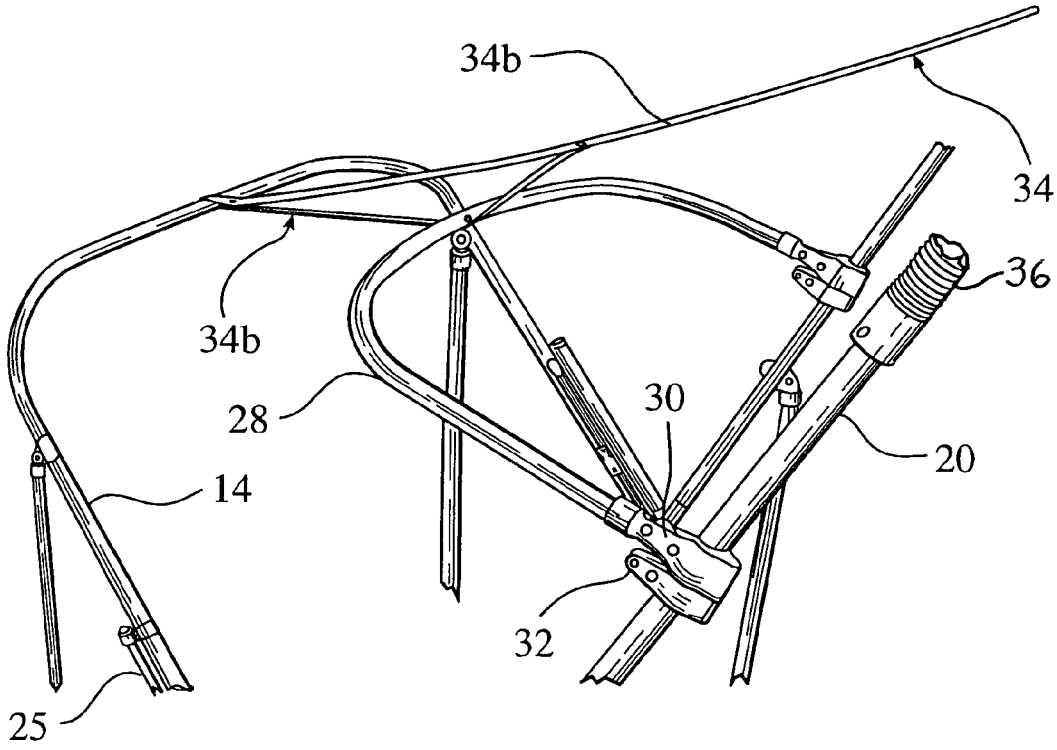
FIG. 5 is a side perspective view of the top portion of the frame assembly of the present automated bimini top device between its extended and retracted state.

Referring more particularly to FIGS. 3 and 5, a middle cross bow member 28 is further included in the fold-away frame assembly 11 for supporting the canvas material 12 in its extended position intermediate of the rear bow member 14 and front bow member 20 when fully deployed and to further prevent the extended canvas from sagging. The side legs of the middle cross bow member 28 are pivotally connected on each side to respective legs of the front bow member 20 using jaw slides 30. The jaw slides 30 are a traditional mounting device that allow a bow to swing or pivot in place 180 degrees. During deployment of the present fold-away frame assembly 11, the middle cross bow member 28 is adapted to pivot upon the front bow member 20 via the jaw slides 30 and made to swing a certain angle away from the front bow and toward the rear bow member 14 into a position wherein the top arm or crossbar of the middle cross bow is substantially at the same level as the crossbars of the rear bow and front bow members when fully deployed. A jaw slide stop 32 is stationed along each side of the front bow 20 just rearward of the jaw slides 30 to engage the sides of the pivoting middle cross bow 28 and thereby stop the rearward pivotal movement of the middle cross bow at the desired angle. Alternatively, the jaw slides 30 may be fitted with a mechanical stop to limit the rotation of the middle cross bow 28 therein.

A guide strap support 34 is secured between the respective crossbars of the rear bow 14 and front bow 20 and centrally positioned along each. The guide strap support 34 is formed having an extended line section 34*a* that is connected between the rear bow 14 and front bow 20 and a loop section 34*b* that is routed centrally about the respective crossbars of the rear bow 14 and the middle cross bow 28. The guide strap support 34 along its line section 34*a* is fastened beneath the canvas material 12, typically by sewing, and via the loop section 34*b* serves during deployment of the fold-away frame assembly 11 to pull the middle cross bow 28 in a guided fashion away from its folded position alongside of the front bow 20 and toward the rear bow 14 until the jaw slide stops 32 engage the sides of the middle cross bow stopping it in the desired intermediate position in the fully deployed position of the assembly shown in FIG. 3. In retraction of the fold-away frame assembly 11, the loop section 34*b* of the guide strap support 34 serves to support the level of the middle cross bow 28 preventing it from swinging downward and allowing the middle cross bow to move forward and back onto the front bow 20 in the fully retracted position. A take-up roller 35 is mounted centrally along the crossbar of the front bow 20 and assembled in conjunction with an associated torsion spring 36 to roll up and collect the canvas material during retraction. Substantially similar to the arched roller assembly shown and described in U.S. Patent Publication No. 2009-0031942, the spring-loaded take-up roller 35 also acts to draw the guide strap line 34*a* and loop section 34*b* in tension during retraction of the frame assembly 11 further preventing the canvas material from sagging during the fold-up retraction of the frame assembly 11.

Therefore, it is apparent that the described invention provides an improved retractable bimini top for recreational boats that is fully automated and capable of easy mounted attachment to the deck of the boat or other rigid supporting structure thereon. More particularly, the disclosed inventive device provides an improved automated bimini top device capable of deployment in a free-standing unit that is readily mounted upon a boat deck or radar arch without any additional supporting framework or binding straps. In the described embodiment, the present automated bimini top device is capable of providing recreational boats with effective sunshade protection for persons on board without presenting obstacles to their movement or obstructions to their performance of tasks on or around the deck. The disclosed automated bimini top device is particularly suitable for retrofitting existing recreational boats with needed means for shade protection of those on board. In addition, the present inventive device is capable of hands free operation and supplying shade protection quickly and reliably whenever required. Furthermore, the disclosed automated bimini top device is relatively inexpensive to manufacture, easy to assemble and ready to install upon existing boat structure.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Accordingly, it is understood that this invention is not limited to the particular embodiment described, but rather is intended to cover modifications within the spirit and scope of the present invention as expressed in the appended claims.

What is claimed:

1. An automated bimini top device for a boat structure, comprising:

a piece of canvas material;

a frame assembly erected upon the boat structure and operatively connected to support the canvas material thereon, said frame assembly being adapted to fold together in reversible directions between a retracted and an extended position with the canvas material supported thereon, said frame assembly including a first bow member supported in a fixed raised position, a second bow member adapted to slide along a length of the first bow member and pivot relative thereto, and a third bow member pivotally connected along a length of the second bow member and adapted to rotate relative thereto;

actuator means operatively connected to the first bow member for moving the second bow member in reversible directions along the length of the first bow member pivotally outward therefrom into the extended position and backward along the length pivotally inward toward the first bow member into the retracted position; and strap means connected between the first and second bow members and looped intermediately therebetween about the third bow member for rotating the third bow member in opposite directions during movement of the second bow member, said strap means being further attached beneath the canvas material to maintain the canvas material upon the frame assembly between the retracted and the extended positions thereof.

2. An automated bimini top device according to claim 1, wherein said frame assembly further comprises:

a pair of first struts erected upon the boat structure and connected to the first bow member on either side thereof to support the fixed raised position thereof; and a pair of second struts pivotally mounted on either side of the frame assembly and pivotally connected along the second bow member to allow for proper folding movement thereof.

3. An automated bimini top device according to claim 1, wherein said frame assembly further comprises:

a guide track member disposed along each side of the first bow member; and a deck hinge slide pivotally connected to each side of the second bow member and adapted to engage the guide track member on either side of the first bow member.

4. An automated bimini top device according to claim 3, wherein said actuator means comprises:

a hydraulic actuator attached along the first bow member and operatively connected to move the deck hinge slide in reverse directions along the guide track member.

5. An automated bimini top device according to claim 1, wherein said frame assembly further comprises:

a jaw slide attached along each side of the second bow member and pivotally connected to each side of the third bow member to allow the third bow member to swing in place 180 degrees relative to the second bow member; and a jaw slide stop stationed along each side of the second bow member adjacent to the jaw slide to limit swing angle of the third bow member relative to the second bow member.

6. An automated bimini top device according to claim 1, wherein said strap means comprises:

a guide strap fastened to the canvas material along the length thereof, the guide strap being formed having a linear section extending between the first bow member and a loop section routed centrally about the first bow member and the third bow member to draw the third bow member in a guided fashion away from the second bow member and toward the first bow member during extension of said frame assembly.

* * * * *